US009011179B2

(12) United States Patent
Siahaan et al.

(10) Patent No.: US 9,011,179 B2
(45) Date of Patent: Apr. 21, 2015

(54) ASSEMBLY OF A CABLE

(75) Inventors: Edward Siahaan, San Francisco, CA (US); Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 268 days.

(21) Appl. No.: 13/610,326

(22) Filed: Sep. 11, 2012

(65) Prior Publication Data

US 2014/0073185 A1 Mar. 13, 2014

(51) Int. Cl.

| | |
|---|---|
| ***H01R 13/52*** | (2006.01) |
| ***H01R 13/504*** | (2006.01) |
| ***H01R 13/6593*** | (2011.01) |
| ***H01R 43/00*** | (2006.01) |
| ***H01R 43/20*** | (2006.01) |
| *H01R 12/53* | (2011.01) |

(52) U.S. Cl.

CPC ..... *H01R 13/52* (2013.01); *Y10T 29/49147* (2015.01); *Y10T 29/49149* (2015.01); *H01R 12/53* (2013.01); *H01R 13/504* (2013.01); *H01R 13/5216* (2013.01); *H01R 13/6593* (2013.01); *H01R 43/005* (2013.01); *H01R 43/205* (2013.01)

(58) Field of Classification Search

USPC ..... 439/607.55–607.59, 76.1, 606, 936

See application file for complete search history.

(56) References Cited

U.S. PATENT DOCUMENTS

| | | | | |
|---|---|---|---|---|
| 4,985,000 | A * | 1/1991 | Tengler et al. | 439/497 |
| 5,385,490 | A * | 1/1995 | Demeter et al. | 439/579 |
| 5,451,169 | A * | 9/1995 | Corbett et al. | 439/289 |
| 6,964,575 | B1 * | 11/2005 | Sailor | 439/76.1 |
| 7,102,082 | B2 * | 9/2006 | Ortiz et al. | 439/606 |
| 7,160,117 | B2 * | 1/2007 | Ngo | 439/76.1 |
| 7,422,488 | B1 | 9/2008 | Wu | |
| 7,445,490 | B2 * | 11/2008 | Jacobson | 439/465 |
| 7,722,362 | B2 * | 5/2010 | Frake et al. | 439/76.1 |
| 8,461,465 | B2 | 6/2013 | Golko et al. | |
| 8,517,751 | B1 | 8/2013 | Golko et al. | |
| 8,517,766 | B2 | 8/2013 | Golko et al. | |
| 8,535,075 | B1 | 9/2013 | Golko et al. | |
| 8,708,745 | B2 | 4/2014 | Golko et al. | |

(Continued)

FOREIGN PATENT DOCUMENTS

| | | | | |
|---|---|---|---|---|
| JP | 11238415 A | * | 8/1999 | H01B 7/08 |
| WO | 2011108292 A1 | | 9/2011 | |

OTHER PUBLICATIONS

International Search Report and Written Opinion for PCT Patent Application No. PCT/US2013/037953, mailed Jul. 9, 2013, 10 pages.

*Primary Examiner* — Briggitte R Hammond

(74) *Attorney, Agent, or Firm* — Kilpatrick Townsend & Stockton LLP

(57) ABSTRACT

An electrical connection assembly includes a connector and a cable. The connector includes a plug having a multitude of contacts in electrical communication with the cable wires. The connector further includes a body in which a printed circuit board is inserted. The cable wires are soldered to the bonding pads of the printed circuit board which is encapsulated by an adhesive. The connector further includes a metallic shield enclosing the body and providing a path to the ground. An inner mold encapsulates the space enclosed by the metallic shield. The metallic shield is optionally formed from a pair of metallic shields cans that are crimped and laser welded. The assembly further includes a sleeve attached at a rear face of the metallic shield, an enclosure attached to the connector body, and a pair of face plates attached between the enclosure and the body.

20 Claims, 4 Drawing Sheets

(56) References Cited

U.S. PATENT DOCUMENTS

| | | | | |
|---|---|---|---|---|
| 8,851,924 | B2 * | 10/2014 | Fleischmann et al. | 439/607.57 |
| 2011/0083324 | A1 | 4/2011 | Martauz et al. | |
| 2011/0195592 | A1 * | 8/2011 | McGrath et al. | 439/607.41 |
| 2011/0230074 | A1 * | 9/2011 | Schmidt et al. | 439/660 |
| 2011/0312219 | A1 * | 12/2011 | Siahaan et al. | 439/625 |
| 2012/0028495 | A1 * | 2/2012 | Su et al. | 439/607.55 |
| 2013/0084746 | A1 * | 4/2013 | Siahaan et al. | 439/607.41 |
| 2013/0115821 | A1 | 5/2013 | Golko et al. | |
| 2013/0149911 | A1 | 6/2013 | Golko et al. | |
| 2013/0217253 | A1 | 8/2013 | Golko et al. | |
| 2014/0073185 | A1 * | 3/2014 | Siahaan et al. | 439/607.58 |
| 2014/0170907 | A1 | 6/2014 | Golko et al. | |

* cited by examiner

ASSEMBLY OF A CABLE

CROSS-REFERENCE TO RELATED APPLICATIONS

The present application is related to U.S. application Ser. No. 13/607,366, commonly assigned, the content of which is incorporated herein by reference in its entirety.

BACKGROUND OF THE INVENTION

The present invention relates to electrical connectors such as audio, video and data connectors.

The use of mobile consumer electronic devices is on the rise. Such devices often communicate with other electronic devices or charging stations via one or more connectors disposed in a connector-cable assembly. The increased complexity and functions performed by such devices, i.e., smartphones, media players, and the like, require new approaches to the electrical connectors that such devices use.

Many standard data connectors are only available in sizes that are limiting factors in making portable electronic devices smaller. Furthermore, many conventional data connectors, such as a USB connector, can only mate with a corresponding connector in a single, specific orientation. It is sometimes difficult for the user to determine whether such a connector is oriented in the correct insertion position. In addition to the orientation problem, even when such a connector is properly aligned, the insertion and extraction of the connector is not always precise, and may have an inconsistent feel. Further, even when the connector is fully inserted, it may have an undesirable degree of wobble that may result in either a faulty connection or breakage. Moreover, many conventional connectors have an interior cavity that is prone to collecting and trapping debris which may interfere with the electrical connections and affect signal integrity.

Many other commonly used data connectors, including standard USB connectors, mini USB connectors, FireWire connectors, as well as many of the proprietary connectors used with common portable media electronics, suffer from some or all of these deficiencies.

BRIEF SUMMARY OF THE INVENTION

Embodiments of the present invention relate to electronic connectors that overcome many or all of the above described shortcomings of conventional connectors. Other embodiments of the present invention relate to methods of manufacturing such electronic connectors.

Some embodiments of the present invention relate to improved plug connectors that have a reduced plug length and thickness, an intuitive insertion orientation, and a smooth, consistent feel when inserted and removed from a corresponding receptacle connector. Additionally, some embodiments of plug connectors according to the present invention only include external contacts. Furthermore, their internal cavity is encapsulated to provide protection against debris, liquids, and other external elements.

In accordance with one embodiment of the present invention, a method of forming a connection between a connector and a cable includes, in part, inserting a printed circuit board into a cavity formed in the connector body and soldering the cable wires to the bonding pads of the printed circuit board. After encapsulating the printed circuit board with an adhesive, the body is enclosed with a metallic shield. Next, first and second molding operations are performed to encapsulate the space enclosed by the metallic shield and to form a sleeve at a rear face of the metallic shield. Finally, a pair of face plates are adhesively bonded between the enclosure and the connector body.

In one embodiment, the metallic shield includes a pair of metallic shields that are crimped and welded together using a laser beam. The adhesive encapsulating the printed circuit board may be dispensed from one or more nozzles using a high pressure high accuracy jetting action and thereafter cured using a UV light.

In one embodiment, at least one of the cable wires bonded to the printed circuit board is a ground connection providing a first conductive path to a ground terminal. Furthermore, the cable's braid, the metallic shield, and a metal ground ring defining a shape of the connector form a second conductive path to the ground. At least one of the cable's braid may also be coupled to the cable wire forming the first ground connection.

An electrical connection assembly, in accordance with one embodiment of the present invention includes, in part, a cable and a connector adapted to be inserted into a receptacle connector of a host device. The connector includes a plug and a body. The connector plug includes a multitude of contacts adapted to receive electrical signals from and supply electrical signals to a multitude of wires in the cable. The connector body includes, in part, a printed circuit board, a viscous adhesive encapsulating the printed circuit board, a metallic shield enclosing the body, and a mold encapsulating the inner space enclosed by the metallic shield. The printed circuit board includes, in part, one or more Integrated Circuits, and a multitude of bonding pads that are soldered to the cable wires.

DETAILED DESCRIPTION OF THE INVENTION

Embodiments of the present invention relate to electronic connectors that overcome many of the shortcoming of commercially available connectors. For example, some embodiments of the present invention relate to connectors that have a reduced size and are fully encapsulated to provide maximum protection against external debris and gases.

Figure 1:
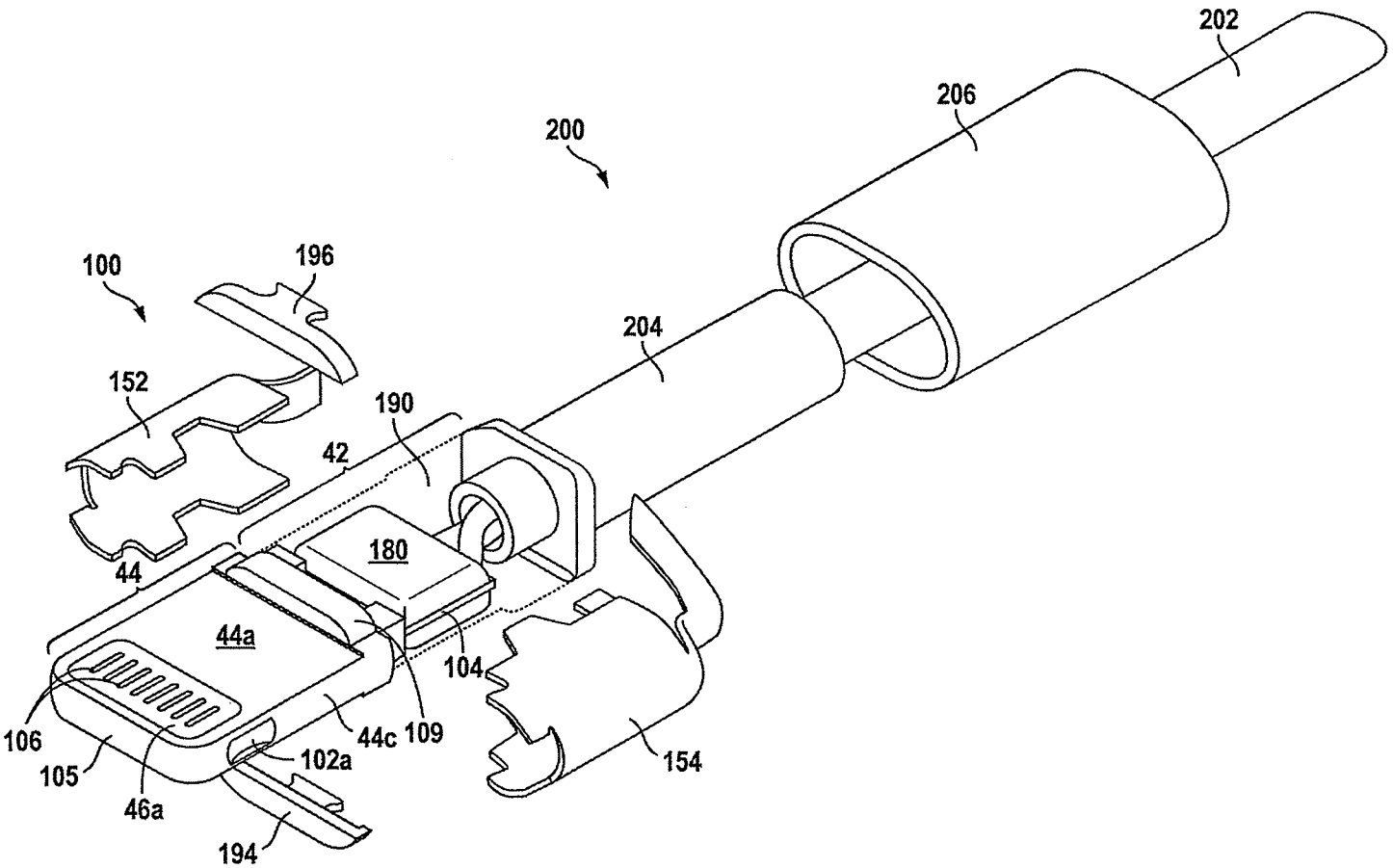
FIG. 1 is a simplified perspective view of a connector plug and an associated cable, in accordance with one embodiment of the present invention.

FIG. 1 is a simplified perspective view of a connector-cable assembly that includes a plug connector 100 and an associated cable 200, in accordance with one embodiment of the present invention. Plug connector (alternatively referred to herein as connector) 100 is shown as including a body 42 and a tab portion 44 that extends longitudinally away from body 42 in a direction parallel to the connector's length. Cable 200 is attached to body 42 at an end opposite of tab portion (alternatively referred to herein as tab) 44.

Body 42 forms the portion of the connector that a user will hold while inserting or removing the connector from a corresponding receptacle connector. Body 42 can be made from a variety of materials, such as a thermoplastic polymer formed in an injection molding process.

Tab 44 is adapted to be inserted into a corresponding receptacle connector during a mating operation. Tab 44 includes a first contact region 46*a* formed on a first major surface 44*a*, and a second contact region 46*b* (not shown) formed at a second major surface 44*b* (not shown) opposite surface 44*a*. Surfaces 44*a*, 44*b* extend from a distal tip of the tab to a flange 109. When tab 44 is inserted into a corresponding receptacle connector of a host device, surfaces 44*a* and 44*b* abut a housing of the receptacle connector. Tab 44 also includes first and second opposing side surfaces 44*c*, 44*d* (not shown) that extend between the first and second major surfaces 44*a*, 44*b*.

Tab 44 includes a ground ring 105 that may be made from stainless steel or another conductive material. Connector 100 also includes retention features 102*a*, 102*b* (not shown) formed as curved pockets in the sides of ground ring 105. Retention features 102*a*, 102*b* do not extend to either of upper surface 44*a* or lower surface 44*b*. Ground ring 105 may be fabricated using a variety of techniques such as a metal injection molding process. Left shield can 152 and right shield can are 154 are crimped and welded together after cable 200 is attached to connector 100, as described further below. After being crimped and welded together, shield cans 152 and 154 of body 42 form an electrically conductive path to ground ring 105 at flange 109.

Disposed within body 42 is a printed circuit board (PCB) 104 that extends into ground ring 105 between contact regions 46*a* and 46*b* towards the distal tip of connector 100. PCB 104 is mounted using a hot bar solder and brought into electrical communication with contacts 106 of first and second contact regions 46*a* and 46*b*. One or more integrated circuits (ICs), such as Application Specific Integrated Circuits (ASIC) may be mounted on PCB 104 to provide information regarding connector 100 and any accessory or device that connector 100 is part of The ICs may perform such functions as authentication, identification, contact configuration, signal transfer and current or power regulation.

As an example, in one embodiment an ID module is embodied within an IC operatively coupled to the contacts of connector 100. The ID module can be programmed with identification and configuration information about the connector and/or its associated accessory that can be communicated to a host device during a mating event. As another example, an authentication module programmed to perform an authentication routine, for example a public key encryption routine, with circuitry on the host device can be embodied within an IC operatively coupled to connector 100. The ID module and authentication module can be embodied within the same IC or within different ICs. As still another example, in embodiments where connector 100 is part of a charging accessory, a current regulator can be embodied within such ICs. The current regulator can be operatively coupled to contacts that deliver power to charge a battery in the host device and regulate current delivered over those contacts to ensure a constant current regardless of input voltage and even when the input voltage varies in a transitory manner.

Figure 2:
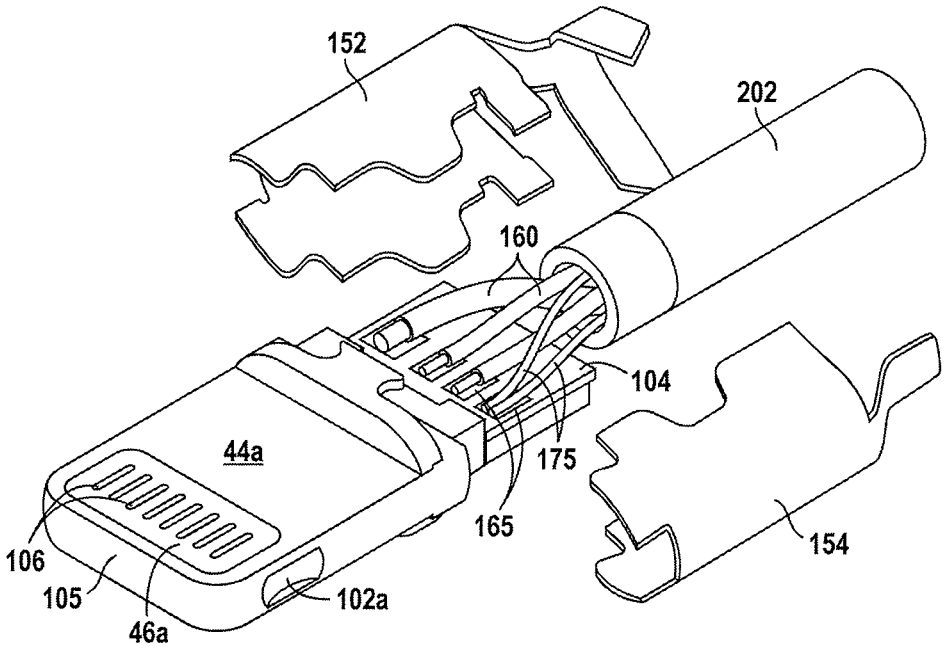
FIG. 2 is another simplified perspective view of the connector plug of FIG. 1, in accordance with one embodiment of the present invention.

In one embodiment, after inserting PCB 104 in body 42, cable 200 is attached to and brought into electrical connection with connector 100. FIG. 2 is another perspective view of connector 100 showing more details of the PCB and cable 200 wires that are soldered thereon. PCB 104 is shown as including a multitude of bonding pads 165 each of which is connected to a contact or contact pair within regions 46*a* and 46*b*. Wires 160 of cable 200 are soldered to bonding pads 165 to form electrical connections to contacts 106. Generally, there is one bonding pad 165 and one wire 160 for each set of electrically independent contacts 106, e.g., a pair of matching connected contacts, one in region 46*a* and one in region 46*b* that are electrically coupled to each other through PCB 104. In other words, each wire in cable 200 is attached to a bonding pad 165 of PCB 104 to form an electrical contact with one of the electrically independent contacts 106 of regions 46*a* and 46*b*. Furthermore, as shown in FIG. 2, one or more ground wires 175 of cable 200 are soldered to a PCB bonding pad to provide a ground connection to which ground ring 105 is also connected.

Each wire in cable 200 may be soldered to a corresponding bonding pad of PCB 104 using an automated, semi-automated or a manual process. In one embodiment, a known length of the cable 200 jacket and wire shields/insulators are stripped so as to expose a predefined length of the metal wires 160. The exposed wires are subsequently fit into a tool that lowers the wires and holds them against the corresponding PCB bonding pads to carry out a hot bar soldering process. The hot bars are shaped so as to push and hold the wires against the bonding pads as the heat is applied and soldering takes place. The bonding pads have solder bumps to facilitate the soldering. In some embodiments, flux and paste may be applied to facilitate the soldering operation. In another embodiment, each wire is welded to its corresponding bonding pad. Many other conductor attachment processes may also be used.

In one embodiment, following the attachment of cable 200 to body 42 (i.e., after soldering the wires of cable 200 to the bonding pads of the PCB disposed in body 42), an encapsulation process is performed to encapsulate, using an adhesive compound, the PCB, all metal traces, vias, contacts, cable terminations, ICs, active and passive components and any other elements/wires that may be electronically exposed. The encapsulating adhesive is dispensed from one or more nozzles using a high pressure high accuracy jetting action. The adhesive is viscous, and after bing cured, robustly insulates all such areas from particles, gases and liquids. The UV cured encapsulating adhesive is shown in FIG. 1 using reference numeral 180. Although not shown, it is understood that a similar encapsulating adhesive also covers the bottom side of the PCB and any other elements/wires that is electronically exposed on the bottom side.

Figure 3:
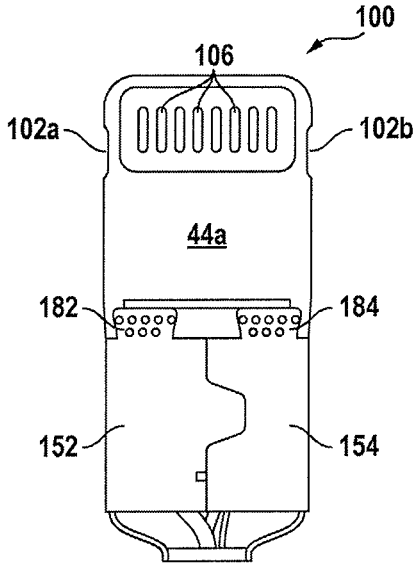
FIG. 3 is a top view of the connector plug after its shield cans are joined and welded together, in accordance with one embodiment of the present invention.

In one embodiment, following the adhesive encapsulation, the left and right metallic shield cans 152 and 154 are crimped together and spot welded to create, among other things, a mechanical joint that distributes the load from connector 100 to cable 200. Therefore, the load distribution is performed through the metallic shield cans 152 and 154. In on example, the two metallic shield cans (also referred to as metallic shields or shield cans) are welded at multiple locations. During the crimping operation, cable 200 is also crimped to provide mechanical rigidity as well as electrical continuity for the ground as well as other signals. FIG. 3 is a top schematic view of connector 100 after metallic shield cans 152, 154 are crimped and spot welded at regions 182, 184 positioned on the upper surfaces of the shield cans, as well as two similar regions (not shown) positioned on the lower surfaces of the shield cans. In one example, each such area has 8 welding spots.

Connector 100 together with cable 200 provide multiple ground paths. One such path is formed by a multitude of drain wires that are soldered to a bonding pad on the PCB. For example, as shown in FIG. 2, a pair of drain wires 175 of cable 200 are soldered to a bonding pad 165 on PCB 104 to provide a path to the ground. This bonding pad is also coupled to one or more contacts 106 in contact regions 46*a* and 46*b* of connector 100. Another ground path is formed through the braid of cable 200, metallic shields 152, 154 and ground ring 105. To further enhance the grounding mechanism, one or more of the braid strands of cable 200 are twisted and bundled with drain wires 175 which are then soldered to the PCB board bonding pad, as shown in FIG. 2.

In one embodiment, following the crimping of the metallic shields 152, 154 and cable 200, a first insert molding operation is performed to further encapsulate the entire inner space enclosed by the metallic shields. This inner overmold, identified using reference numeral 190 in FIG. 1, fully encloses the adhesive compound 180 and any available space between the crimped metallic shield cans.

Figure 4A:
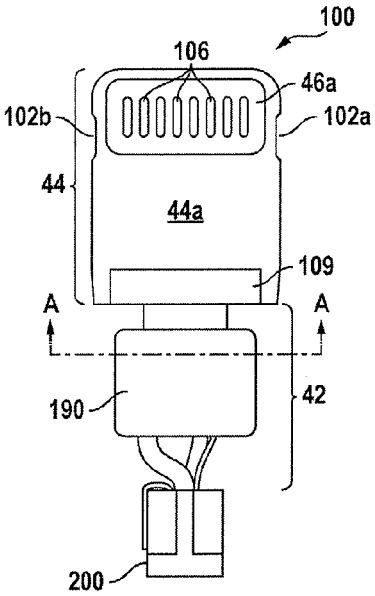
FIG. 4A is a top view of a side of the connector of FIG. 1 receiving the cable wires, in accordance with one embodiment of the present invention.
Figure 4B:
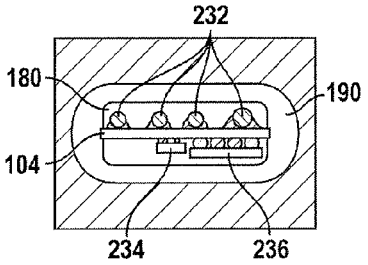
FIG. 4B is a cross-sectional view of the connector of FIG. 4A viewed along lines AA, in accordance with one embodiment of the present invention.

FIG. 4A is a top view of connector 100's side receiving the cable wires. FIG. 4B is a cross-sectional view of connector 100 of FIG. 4A viewed along lines AA. To aid in understanding FIGS. 4A and 4B, metallic shield cans 252 and 254 are not shown. Shown in FIG. 4B are PCB 104, four solder bumps 232 used to solder the cable wires to the corresponding PCB bonding pads, ICs 234, 236, adhesive encapsulating layer 180, and inner overmold 190.

Referring to FIG. 1, a second insert molding process may be performed afterwards to create an overmolded strain relief sleeve 204 attached to the rear face of the metallic shields and extending over cable 200 for a short distance. The first and second insert molding materials may be any type of plastic or other non-conductive material. In one embodiment, both materials are thermoplastic elastomers with the second insert molding material being of a lower durometer than the first insert molding material.

The next step of the assembly may involve attaching an enclosure 206 to body 42. In FIG. 1, enclosure 206 is shown as being in position to be slid over connector body 42 to substantially enclose the connector body. Enclosure 206 may be manufactured from any type of plastic or other non-conductive material and in one embodiment is made from ABS.

Figure 5:
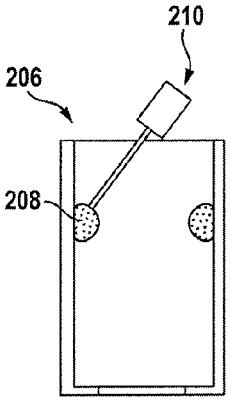
FIG. 5 is a cross-sectional view of an enclosure adapted to enclose a body of the connector of FIG. 1, in accordance with one embodiment of the present invention.

FIG. 5 is a cross-sectional view of enclosure 206. This figure further depicts bonding material 208 deposited on two locations on an inside surface of enclosure 206. The bonding material may be deposited with a syringe and needle assembly 210 as shown, or it can be deposited with myriad other techniques.

Figure 6:
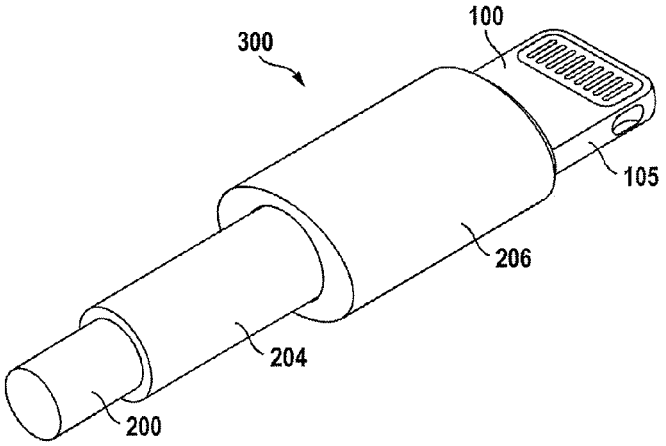
FIG. 6 is a perspective view of a completed connector and cable assembly, in accordance with one embodiment of the present invention.

FIG. 6 shows connector 100 and cable 200 after enclosure 206 has been moved into its final place to substantially enclose the connector body. Bonding material 208 may be cured, adhering the inside surface of enclosure 206 to the outside surface of the connector body. In some embodiments, the bonding material may be a cyanoacrylate that cures in the presence of moisture. In other embodiments the bonding material may be an epoxy or urethane that is heat cured. Other bonding materials are well known and may be used.

Referring to FIGS. 1 and 6, after attaching enclosure 206 as described above, top faceplate 196 and bottom faceplate 194 are adhesively bonded between enclosure 206 and body 42 to complete the connector and cable assembly.

Figure 7:
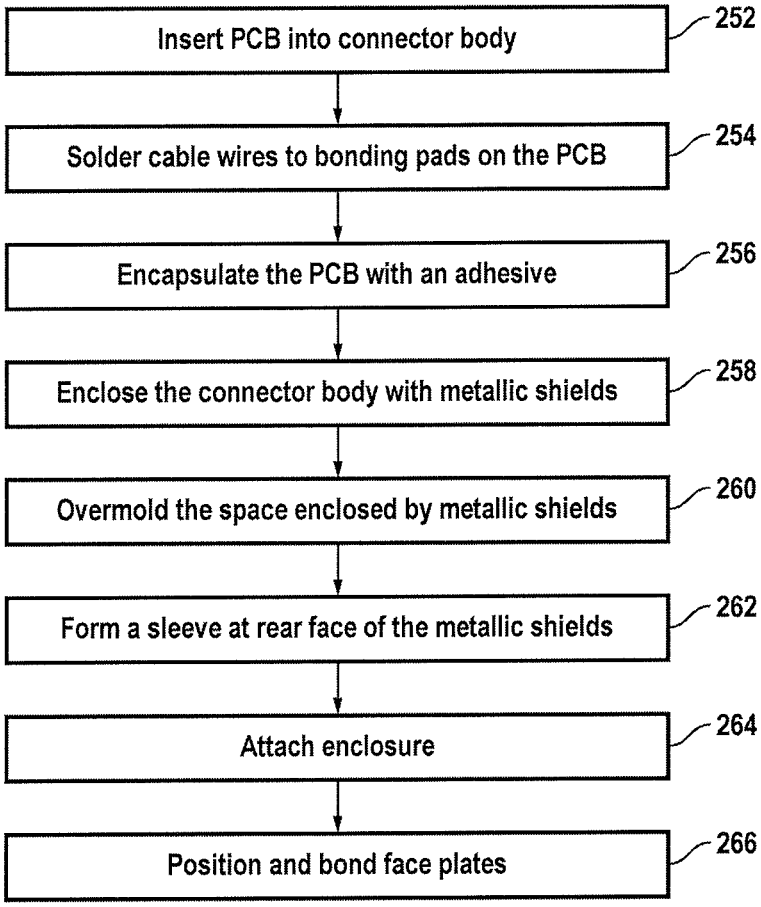
FIG. 7 is a flowchart of steps performed to manufacture and attach a connector to a cable, in accordance with one embodiment of the present invention.

FIG. 7 is a flowchart 250 showing the steps performed to manufacture and attach a connector to a cable, in accordance with one embodiment of the present invention. At 252, a printed circuits board that contains ICs and bonding pads is inserted into a cavity of the connector body. At 254, the cable wires are soldered to the bonding pads of the printed circuit board to form a multitude of electrical connections. At 256, the surfaces of the printed circuit are encapsulated with an adhesive. At 258, a metallic shield is used to enclose the body. At 260, the space enclosed by the metallic shield is encapsulated with an overmold. At 262, a sleeve is formed at the rear face of the metallic shield. At 264, an enclosure is attached to the connector body. Finally at 266, a pair of face plates are bonded between the enclosure and the connector body using an adhesive.

The above embodiments of the present invention are illustrative and not limitative. Various alternatives and equivalents are possible. The invention is not limited by the type of device mating with a connector and a cable assembly in accordance with embodiments of the present invention. The invention is not limited by the type of adhesive or molding used. The invention is not limited by the number of conductors in the cable. Nor is the invention limited by the type of integrated circuit disposed in the connector. Other additions, subtractions or modifications are obvious in view of the present disclosure and are intended to fall within the scope of the appended claims.

What is claimed is:

1. An electrical connection assembly comprising a connector and a cable, said connector adapted to be inserted into a receptacle connector and comprising:

a plug having a plurality of contacts adapted to receive electrical signals from and supply electrical signals to a plurality of wires in the cable; and a body comprising:

a printed circuit board including a plurality of bonding pads attached to a plurality of wires of the cable;

a cured viscous adhesive encapsulating the plurality of bonding pads on the printed circuit board;

a metallic shield enclosing the body; and a first mold encapsulating a space enclosed by the metallic shield.

2. The electrical connection assembly of claim 1 wherein the metallic shield comprises first and second said metallic shields that are crimped and welded together to cover the body.

3. The electrical connection assembly of claim 2 wherein said electrical connection assembly further comprises a sleeve at a rear face of the first and second metallic shields.

4. The electrical connection assembly of claim 3 wherein said electrical connection assembly further comprises an enclosure attached to the connector body.

5. The electrical connection assembly of claim 4 wherein said electrical connection assembly further comprises first and second face plates adhesively attached between the enclosure and the body.

6. The electrical connection assembly of claim 1 wherein said viscous adhesive is dispensed on the printed circuit board from one or more nozzles using a high pressure high accuracy jetting action.

7. The electrical connection assembly of claim 6 wherein said viscous adhesive is UV cured after being dispensed.

8. The electrical connection assembly of claim 1 wherein at least one of the plurality of soldered wires provides a first conductive path to a ground terminal.

9. The electrical connection assembly of claim 8 wherein the cable's braid, the first and second metallic shields and a metal ground ring defining a shape of the plug are electrically coupled to form a second conductive path to the ground terminal.

10. The electrical connection assembly of claim 9 wherein a plurality of the cable's braid are coupled to the cable wires forming the first conductive path to the ground terminal.

11. The electrical connection assembly of claim 1 wherein the printed circuit board further includes at least one integrated circuit and a plurality of metal traces and the cured viscous adhesive encapsulates the at least one integrated circuit and the plurality of metal traces in addition to the plurality of bonding pads.

12. An electrical connector comprising:

a metallic shield defining an interior cavity between exterior surfaces of the metallic shield;

a connector plug extending away from the metallic shield;

a printed circuit board extending from at least a portion of the connector plug into the interior cavity, the printed circuit board having at least one integrated circuit, a plurality of metal traces and a plurality of bonding pads formed thereon;

a cable comprising a plurality of wires and a metal braid, each of the plurality of wires having an exposed end that is soldered to a bonding pad in the plurality of bonding pads;

a cured viscous adhesive formed within the interior cavity over at least a portion of the printed circuit board and encapsulating the at least one integrated circuit, the plurality of metal traces, the plurality of metal bonding pads and the exposed end of each of the plurality of wires;

a plurality of contacts adapted to receive electrical signals from and supply electrical signals to the plurality of wires in the cable; and a first insert mold fully covering the cured viscous adhesive and filling space within the interior cavity defined by the metallic shield.

13. The electrical connector set forth in claim 12 wherein the metallic shield includes first and second shield cans crimped and welded together.

14. The electrical connector set forth in claim 12 further comprising a strain relief sleeve attached at a rear face of the metallic shield and extending over the cable.

15. The electrical connector set forth in claim 14 further comprising a plastic enclosure surrounding the metallic shield.

16. The electrical connector set forth in claim 12 wherein at least one of the plurality of soldered wires provides a first conductive path to a ground terminal.

17. The electrical connector set forth in claim 16 wherein the connector plug includes an exterior metal surface that defines a shape of the plug and the plurality of contacts are formed within one or more openings of the exterior metal surface.

18. The electrical connector set forth in claim 17 wherein the braid, the metallic shield and the exterior metal surface are electrically coupled together to form a second conductive path to the ground terminal.

19. The electrical connector set forth in claim 18 wherein a plurality of the cable's braid are coupled to the cable wires forming the first conductive path to the ground terminal.

20. The electrical connector set forth in claim 18 further comprising first and second indentations formed in the exterior metal surface on opposing sides of the plug.

* * * * *